US011220117B2

(12) United States Patent
Martin Orue et al.

(10) Patent No.: US 11,220,117 B2
(45) Date of Patent: Jan. 11, 2022

(54) PRINT TARGET SUPPORT ASSEMBLY

(71) Applicant: HEWLETT-PACKARD DEVELOPMENT COMPANY, L.P., Spring, TX (US)

(72) Inventors: Eduardo Martin Orue, Sant Cugat del Valles (ES); Pablo Arteaga Del Arco, Sant Cugat del Valles (ES); Isidoro Maya Agudo, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/492,978

(22) PCT Filed: Nov. 1, 2017

(86) PCT No.: PCT/US2017/059580
§ 371 (c)(1),
(2) Date: Sep. 11, 2019

(87) PCT Pub. No.: WO2019/089023
PCT Pub. Date: May 9, 2019

(65) Prior Publication Data

US 2020/0254789 A1 Aug. 13, 2020

(51) Int. Cl.
*B41J 2/01* (2006.01)
*B41J 11/00* (2006.01)

(52) U.S. Cl.
CPC ..... *B41J 11/0085* (2013.01)

(58) Field of Classification Search
None
See application file for complete search history.

(56) References Cited

U.S. PATENT DOCUMENTS 5,197,812 A * 3/1993 Worley ..... B41J 11/007 198/811
6,179,285 B1 1/2001 Teumer et al.
6,582,072 B1 6/2003 Wotton et al.
7,333,766 B2 2/2008 Dutoit et al.
10,987,952 B1 * 4/2021 Terrero ..... B41J 11/0085
(Continued)

FOREIGN PATENT DOCUMENTS

WO WO2012023939 A1 2/2012
WO WO2012024125 A1 2/2012

*Primary Examiner* — Erica S Lin
*Assistant Examiner* — Tracey M McMillion
(74) *Attorney, Agent, or Firm* — HP Inc. Patent Department

(57) ABSTRACT

A print target support assembly comprising a print platen structure providing an upper surface to support a print target as the print target passes under a print zone. The print zone is arranged across the surface perpendicular to a direction of print target advance. The surface comprises an inner belt area in the direction of print target advance, the inner belt area bounded on each side by an outer non-belt area. A belt advance mechanism, to advance a belt running across the inner belt area of the surface in the direction of print target advance, to advance the print target under the print zone. A flattening arrangement to flatten the print target onto the surface, under the print zone, across the inner belt area and the outer non-belt areas of the surface.

15 Claims, 8 Drawing Sheets

(56) References Cited

U.S. PATENT DOCUMENTS

| | | | | |
|---|---|---|---|---|
| 2004/0183876 | A1 | 9/2004 | Mizuno et al. | |
| 2010/0265308 | A1 | 10/2010 | Lin et al. | |
| 2015/0343801 | A1 | 12/2015 | Young et al. | |
| 2017/0136787 | A1* | 5/2017 | Martin Vidal ..... | B41J 11/0085 |

* cited by examiner

PRINT TARGET SUPPORT ASSEMBLY

BACKGROUND

A part in a large format printing system, such as a Page Wide Array (PWA) printing system, is a print target support assembly. The print target support assembly comprises a print platen structure that provides an upper surface to support a print target that is to be printed on. A belt advance mechanism comprising one or more belts may be used for advancing the print target across the platen and under a print zone.

BRIEF DESCRIPTION OF THE DRAWINGS

Various features of the present disclosure will be apparent from the detailed description which follows, taken in conjunction with the accompanying drawings, which together illustrate features of the present disclosure, and wherein.

DETAILED DESCRIPTION

Figure 1A:
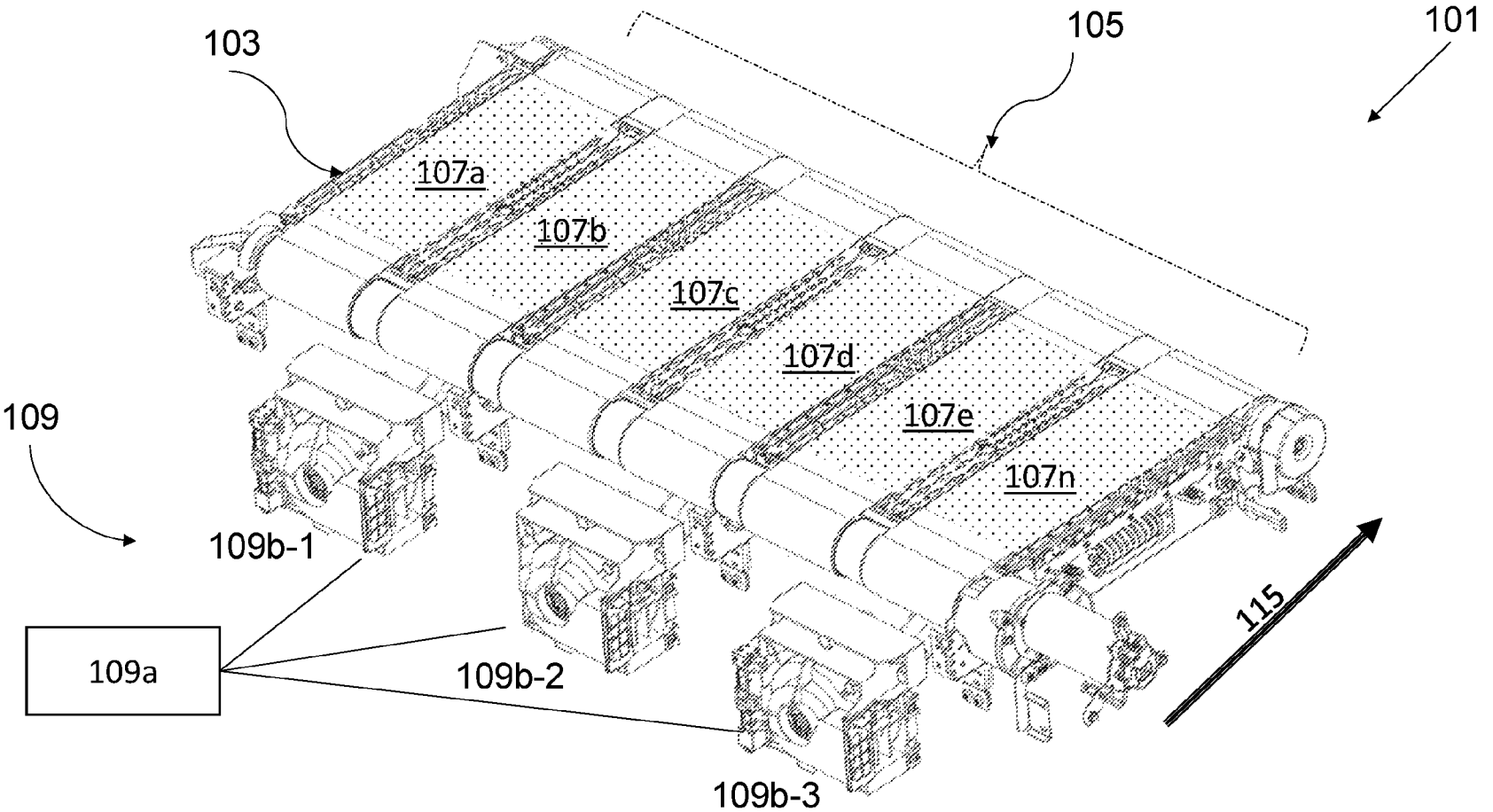
FIG. 1*a* shows a print target support assembly according to an example.
Figure 1B:
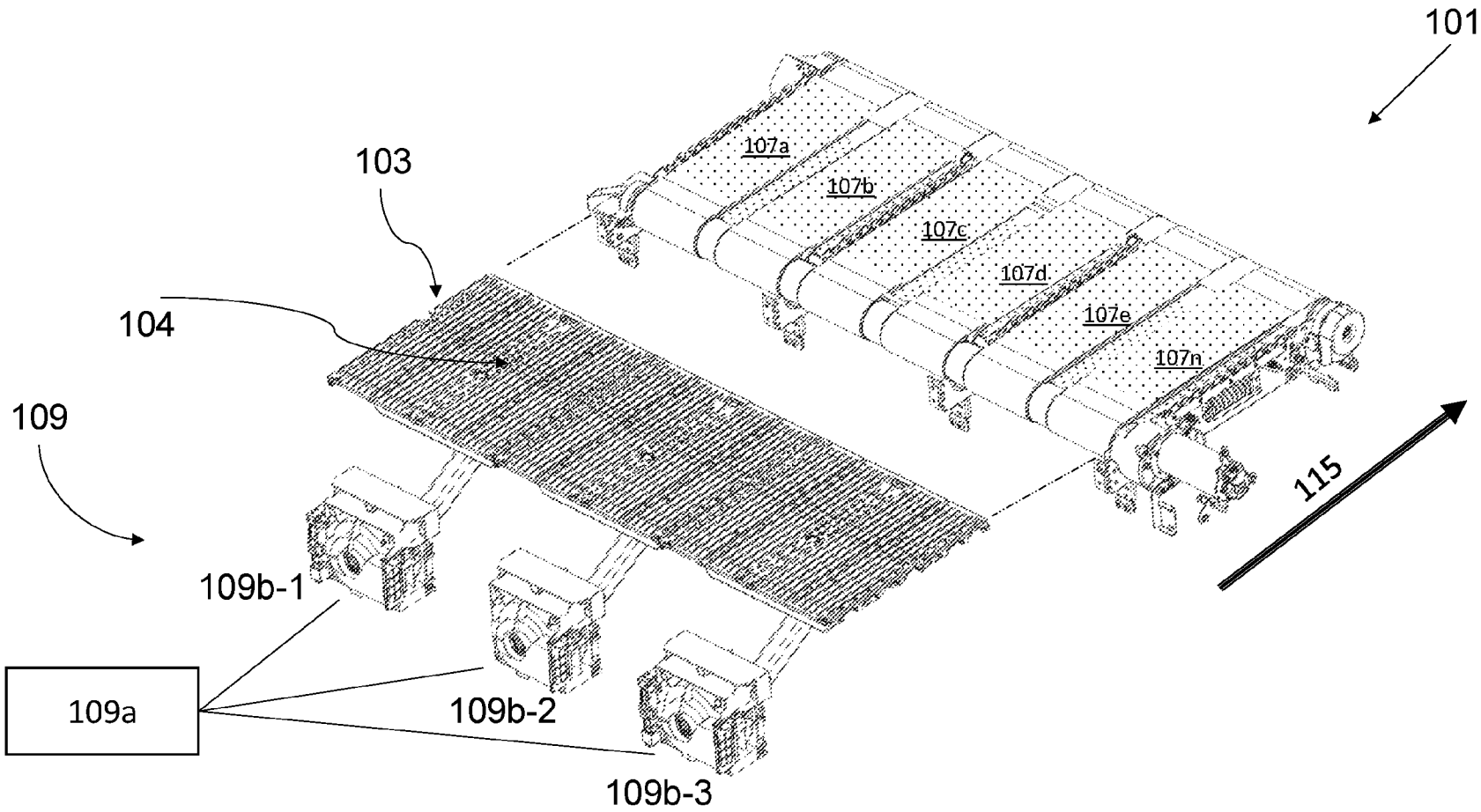
FIG. 1*b* shows an exploded view of the print target support assembly according to the example shown in FIG. 1*a;*
Figure 1C:
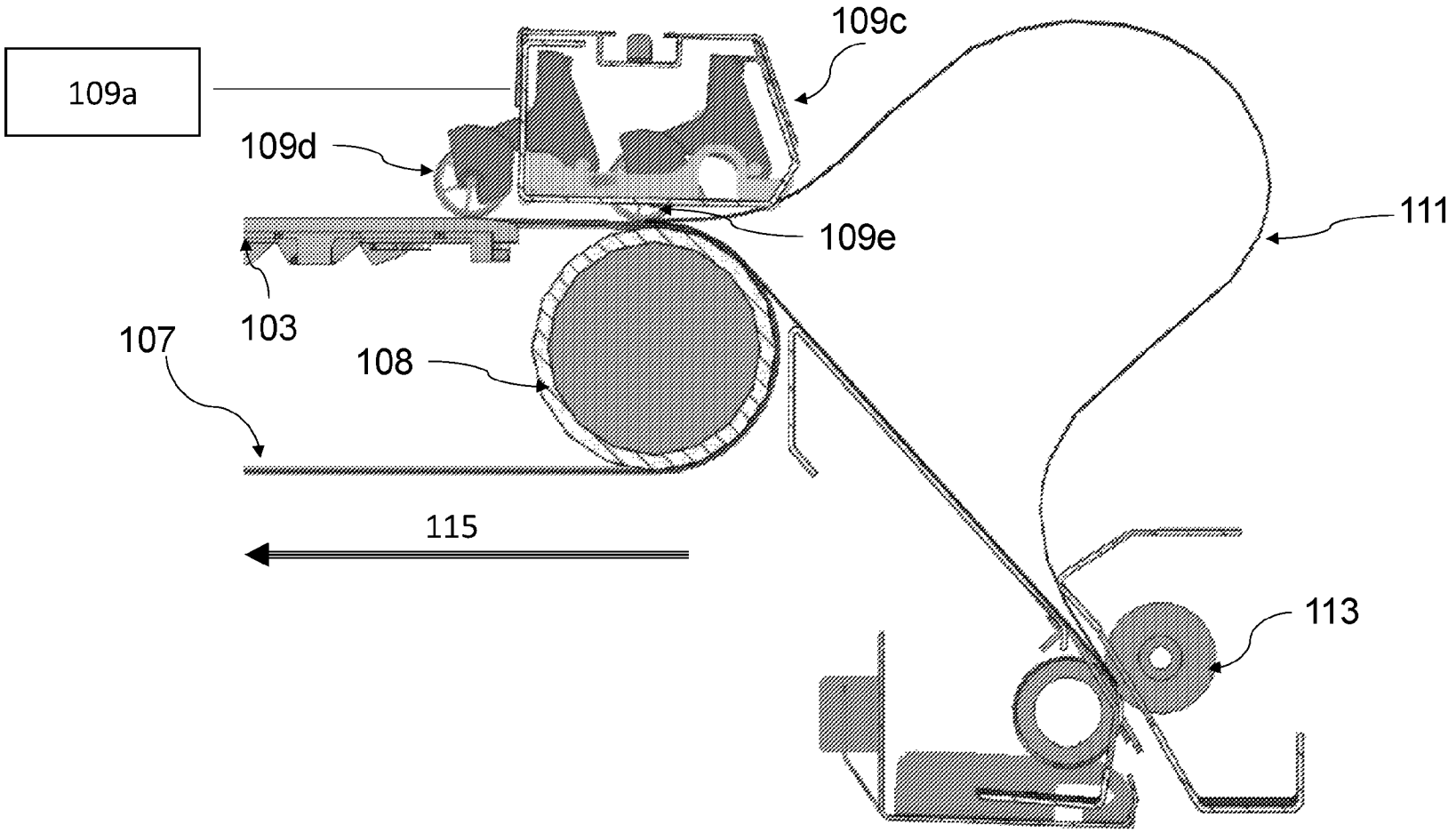
FIG. 1*c* shows a side elevation view of the print target support assembly according to the example shown in FIG. 1*a;*

FIGS. 1*a*-1*c* show a print target support assembly 101 for use in a PWA printing system. The PWA printing system receives input data (for example, an image for two-dimensional printing, or data representing an object for three-dimensional printing) for printing on a print target. Examples of a PWA printing system include a printing system capable of printing on to a print target of width greater than 297 mm (11.69 inches). In examples, a PWA printing system is capable of printing on to a print target, for example a print medium comprising a planar substrate (e.g. paper, cardboard, plastic, fabric, etc.), from 11.69 inches to 40 inches in width, or greater. In case of three-dimensional printing, objects may be formed in a layer-by-layer manner on a print target. A PWA printing system may, for example, be an inkjet printing system comprising a print head (not shown), a processor (not shown) for processing data for use in printing and/or generating print instructions, and/or memory for storing various data and/or print instructions. A PWA printing system may comprise more or different components beyond those described herein, and such details of the PWA printing system have been omitted for brevity and convenience.

The print target support assembly 101 comprises a print platen structure 103, which is best seen in FIG. 1*b* removed from the assembly 101. The print platen structure 103 comprises a single part or a multiple-part print platen. The print platen structure 103 provides an upper surface 104 to support one or more belts and a print target 111 as the print target 111 passes under a print zone (not shown).

The surface 104 comprises a belt area 105, across which the one or more belts 107 are advanced by a belt advance mechanism 108. The belt advance mechanism 108 may, for example, comprise a belt advance circuitry (not shown) for controlling operation the belt advance mechanism 108. The belt advance circuitry may, for example, be actuated based on a sensor sensing movement of the print target 111 in the direction of the surface 104, and may be connected to a bus for receiving input from the sensor. The belts 107, running across the surface 104 in a direction of print target advance (denoted by an arrow with the label 115), advance the print target 111 under the print zone. In FIG. 1*a,* the belt area 105 runs across the width of the surface 104, such that belts 107 are present at the edges of the surface 104.

In examples in which several belts 107*a-n* are used for print target transport, the belts may be spaced apart and, as a consequence, overlap with some parts of the surface 104 in the belt area 105 but not all parts. The combined width of the belt(s) 107*a-n* may therefore be equal to or less than the width of the belt area 105.

The print target support assembly 101 comprises a flattening assembly 109 for maintaining the print target 111 in place as it advances in contact with the belts 107*a-n* under the print zone. The flattening assembly 109 may comprise a controller 109*a* for controlling operation of a flattening arrangement 109*b,* to increase friction sufficiently between the print target 111 and belts such that the target advances as the belts advance. The controller 109*a* may, for example, comprise a control circuitry (not shown), which may be connected to a sensor for sensing movement of the print target 111 in relation to the surface 104 for controlling the operation of the flattening arrangement 109*b.*

The flattening arrangement 109*b* may comprise one or more flattening mechanisms, controlled by respective circuitry, that, when operated, perform a flattening operation on the print target 111. For example, the flattening arrangement 109*b* may comprise a vacuum assembly, which is controlled by the controller 109*a* to apply vacuum under the print platen structure 103 in order to flatten the print target 111 onto the surface 104. In this case, the belts 107*a-n* and the print platen structure 103 may be permeable, so as to allow the vacuum through the platen structure and belts and to draw the print target 111 onto the belts 107*a-n* and surface 104, thereby to provide sufficient friction between the print target 111 and the belts 107*a-n.*

The belts 107*a-n* and the print platen structure 103 may, for example, have through-holes to afford permeability. The vacuum assembly 109*b* may comprise a vacuum source to apply vacuum across the surface 104 or several vacuum sources each to apply vacuum to a portion of the surface 104. The vacuum source may, for example, be a vacuum fan. In FIGS. 1*a* and 1*b* the vacuum assembly 109*b* comprises three vacuum sources, 109*b*-1-109*b*-3. In another example, a single vacuum source may be used in combination with respective channels and valves to apply vacuum controllably to different portions of the surface 104.

In examples, according to FIGS. 1*a*-1*c,* the vacuum assembly 109*b* may apply vacuum under the platen 103 in order to flatten the print target 111 progressively onto the surface 104. In this case, the controller 109*a* may control the operation of the vacuum assembly 109*b* to apply vacuum in a plurality of vacuum zones across the print platen structure 103, progressively, starting from an inner zone and progressing towards outer zones, thereby avoiding any wrinkling of the print target 111 and/or countering any curling-up of the edges of the print target 111 across the print platen structure 103. More specifically, with reference to FIGS. 1*a* and 1*b,* the controller 109*a* may start a vacuum source 109*b*-2, which corresponds with an inner area of the surface, before starting vacuum sources 109*b*-1 and 109*b*-3, which correspond with outer areas of the surface.

In examples, the flattening assembly 109 may comprise a further flattening arrangement 109*c* (see FIG. 1*c*) to ensure initial and consistent flatness of the print target 111 at the target comes into contact with the surface 104. The further flattening arrangement 109*c* may, for example, provide a hold-down force to the print target 111, as it comes in contact with the belts 107, to urge the print target 111 onto the print platen structure 103. In some examples, the further flattening arrangement 109*c* may, for example, be an apparatus to direct pressurized air (or another gas) on to the surface of the print target 111, thereby holding down the print target 111 onto the print platen structure 103. In other examples, as shown with reference to FIG. 1*c*, the further flattening arrangement 109*c* comprises one or more pinch rollers 109*d* biased in a direction towards the print platen structure 103. The pinch rollers 109*d* are in contact with the print target 111, thereby holding the print target 111 down onto the print platen structure 103, for example, in advance of the vacuum zone(s). One or more other pinch rollers, for example 109*e*, of the further flattening arrangement 109*c*, may be biased towards, and urge a print target 111 and belts 107 on, the belt advance mechanism 108.

In examples, the print target support assembly 101 may comprise or be coupled to a print target feeding arrangement 113, that feeds the print target 111 towards the print platen structure 103. The print target feeding arrangement 113 may, for example, comprise feed roller(s). The print target feeding arrangement 113 may be located downstream and/or upstream of the print platen structure 103 to assist the print target 111 in crossing the print platen structure 103 in the direction of print target advance 115.

In the example shown with reference to FIG. 1, the belt area 105 runs across the width of the print zone and the belts 107*a*-*n* overlap with a large part of the surface 104. Belts, however, are costly to manufacture and replace. Therefore, in examples, the surface 104 may comprise a non-belt area, over which belts do not advance, which reduces costs. The non-belt area may, for example, be defined by using a fewer number of belts, and, as a consequence, reducing the area of the surface 104 covered by belts. In the example shown with reference to FIG. 1, a non-belt area may, for example, be defined by omitting outer belts 107*a* and 107*n* of the print target support assembly 101. In this case, the surface 104 comprises an inner belt area (accommodating belts 107*b*-107*e*) bounded on each side by an outer, non-belt area. In some examples, a non-belt area may be located along another, for instance an inner, portion of the surface 104 bounded on each side by a belt area.

Figure 2:
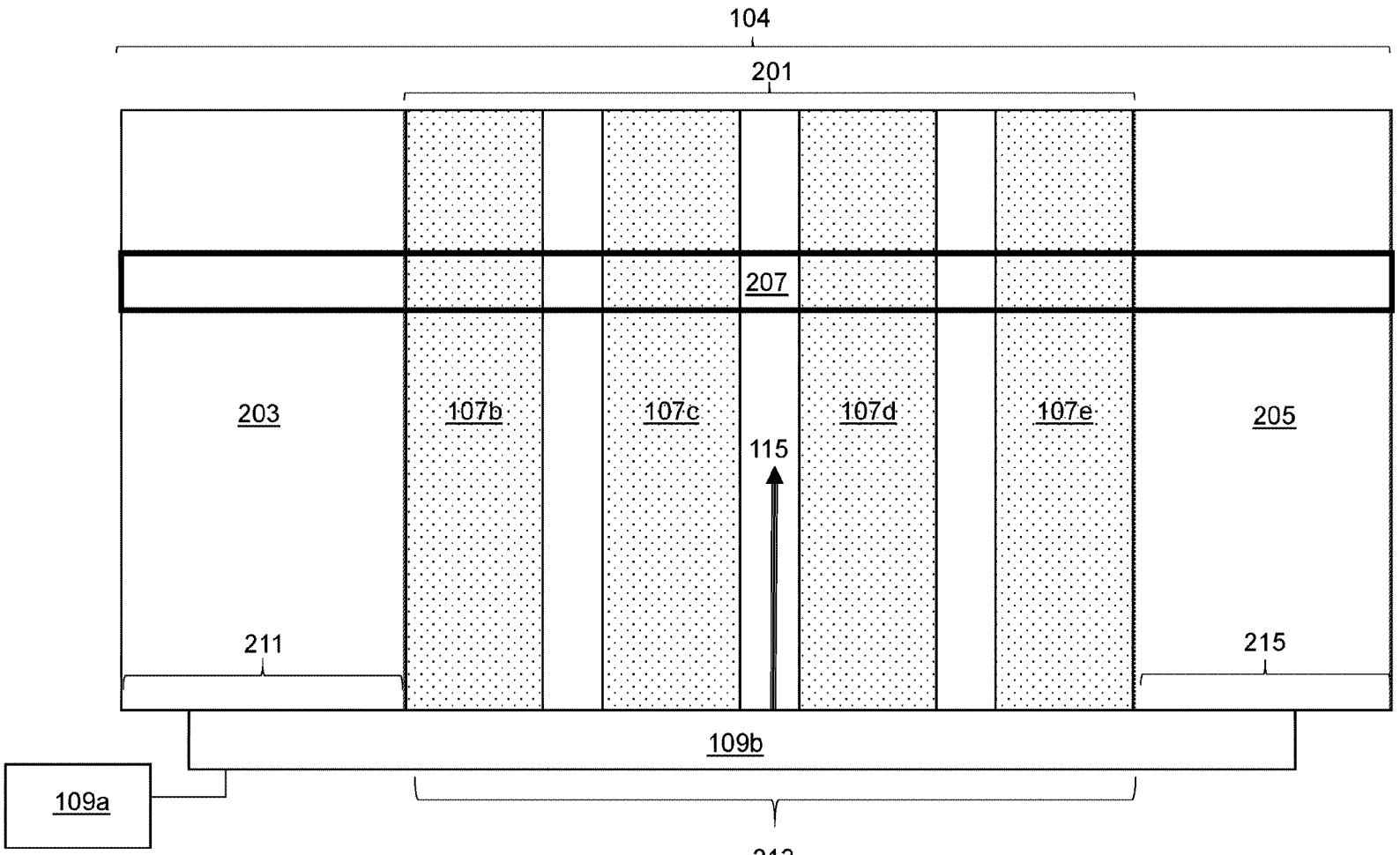
FIG. 2 shows a print target support assembly according to an example.

In the example shown with reference to FIG. 2, the surface 104 comprises an inner belt area 201, in the direction of print target advance 115. The inner belt area 201 is bounded on each side by outer non-belt areas, 203 and 205. A belt advance mechanism 108 advances the belts 107*b*-*e* running across the inner belt area 201 in the direction of print target advance 115 in order to advance print target (not shown) under the print zone 207. In this example, the flattening arrangement 109*a* flattens the print target onto the surface 104, under the print zone 207, across the inner belt area 201 and the outer non-belt areas 203 and 205.

In examples in which the flattening arrangement comprises a vacuum assembly 109*b* to apply vacuum under the print paten structure 103, in order to flatten the print target onto the surface 104, the vacuum assembly 109*a* may apply vacuum in a first vacuum zone 213, corresponding with the inner belt area 201, and in a second vacuum zone, 211 and 215, corresponding with the outer non-belt areas 203 and 205. Therefore, the print target can be appropriately flattened across the belt area 201 and the non-belt areas 203 and 205.

The controller 109*a* may control the flattening arrangement 109*b* such that the print target is flattened progressively, starting from the inner belt area 201 and progressing to the outer non-belt areas 203 and 205. In examples in which the flattening arrangement comprises a vacuum assembly 109*b*, the controller 109*a* controls the vacuum assembly 109*b* to start applying vacuum in the first vacuum zone 213 before applying vacuum in the second vacuum zone 211 and 215 to flatten the print target onto the surface 104. The position of the print target in the inner areas of the surface 104 may ascertainable and/or controlled, for example, on the basis of an encoder and/or other sensor coupled to a print target feeding arrangement. This being the case, by flattening the print target in the inner areas of the surface 104 first and then extending outwards, the flattening arrangement 109*a* ensures that the print target is flat, without wrinkles, as it arrives under the print zone 207. Flattening of the print target in the inner areas first may cause a portion of the print target in the central region to temporarily edge forwards in comparison to other portions of the print target. However, progressive flattening ensures that the leading edge of the print target is consistently flattened under the print zone 207.

In examples, the vacuum assembly 109*a* is controlled by the controller 109 to apply vacuum in a plurality of vacuum zones 211, 213 and 215 across the print platen structure 103 to flatten the print target progressively onto the surface 104. In this case, the vacuum assembly 109*a* starts from a zone 213, corresponding with the inner belt area 201, and progressing towards zones 211 and 215, corresponding with the outer non-belt areas 203 and 205. In examples, there could be further vacuum zones between the zone 213, and the zones 211 and 215 to afford a finer control over the application of vacuum to the zones, for instance, such that progressive vacuum may be applied across all zones from inner towards outer zones.

In examples, the flattening arrangement, comprising a vacuum assembly 109*b*, may operate with a further flattening arrangement (not shown in FIG. 2), such as a plurality of pinch rollers located across the inner belt area 201, for biasing the print target onto the surface 104 in the inner belt area 201. The or each of the pinch rollers may coincide with a belt 107*b*-*e*. There may be no pinch rollers coincident with the non-belt areas, as there would be no belt to co-operate with to advance the print target. Absent other forms of flattening arrangement, this could lead to the edges of the print target, which that are not subjected to pressure from pinch rollers, curling up. In such arrangements, flattening in the belt areas may be accomplished by a combination of vacuum and pinch rollers, whereas, in the non-belt areas, flattening may be accomplished principally by vacuum, and the vacuum may be applied progressively, as has been explained, to avoid wrinkling.

In examples, the width of each of the non-belt areas 203 and 205 is equal to or greater than the width of any of the belts 107*b*-*e*.

In examples, a degree of friction caused by the flattening arrangement 109*b* in the non-belt areas, 203 and 205, may be different to the degree of friction caused in the belt area 201. For instance, the degree of friction in the non-belt area may be lessened, due to the absence of a belt to carry and advance the print target. In any event, the flattening arrangement 109*b* causes adequate friction in the belt area 201 to prevent the target from slipping, with respect to belt advance, due to insufficient friction. The flattening arrangement 109*b* causes adequate friction in the non-belt area to ensure that the target edges are not curled-up but not so much friction that the edges of the target 'drag' and wrinkle, relative to the target in the belt area. The friction caused by the flattening arrangement in the belt area 201 and the non-belt areas 203 and 205 ensures that the print target is moved under the print zone 207 at the same speed as the belts 107*b-e*.

Figure 3:
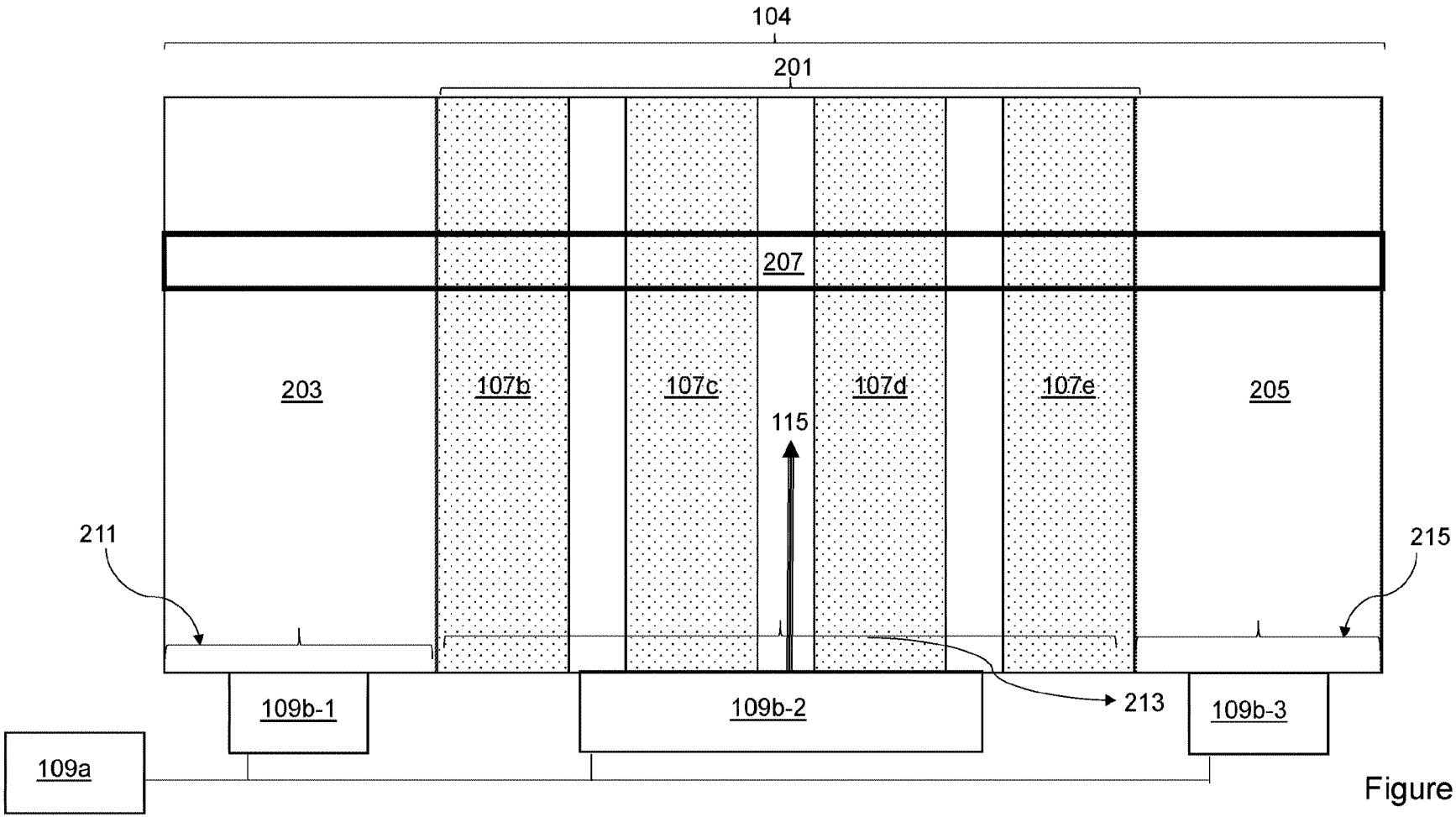
FIG. 3 shows a print target support assembly according to an example.

In the example shown with reference to FIG. 3, a print target support assembly may comprise a first flattening arrangement 109*b*-2 located in the inner belt area 201 and a second flattening arrangement 109*b*-1 in the non-belt area 203. The print target support assembly may comprise a third flattening arrangement 109*b*-3 located in the non-belt area 205. In examples, the controller 109 controls the first flattening arrangement 109*b*-2 to apply vacuum corresponding with the belt area 201 and the second and third flattening arrangements 109*b*-1 and 109*b*-3 to apply vacuum corresponding with the non-belt areas 203 and 205. In examples, the controller 109 controls the flattening operation such that the first flattening arrangement 109*b*-2 starts applying vacuum corresponding with the belt area 201 before the second and the third flattening arrangements 109*b*-1 and 109*b*-3 start applying vacuum corresponding with the non-belt areas 203 and 205 to flatten the print target progressively from the belt area 201 of the surface 104 towards the non-belt area 203 and 205 of the surface 104.

Figure 4A:
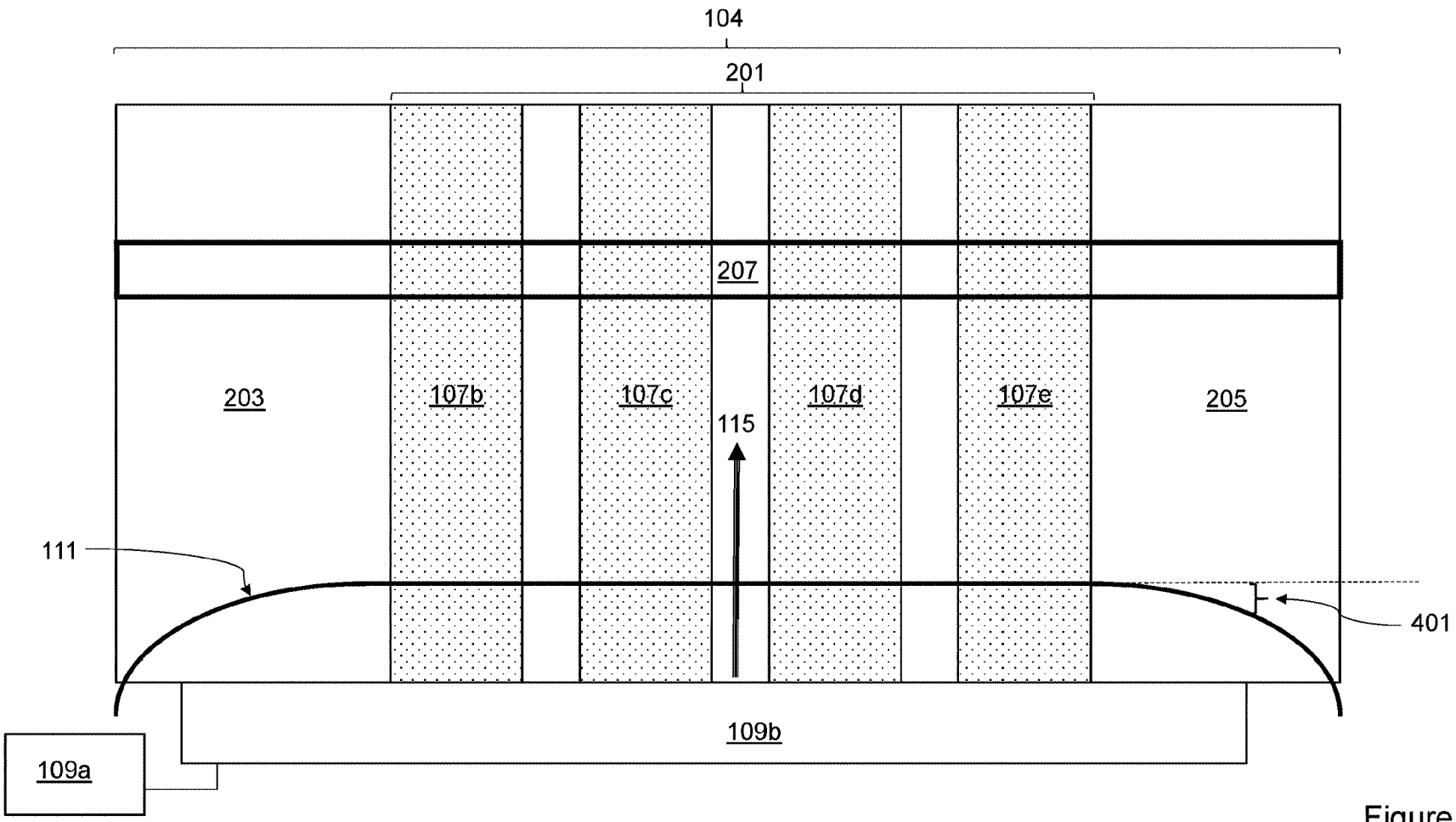
FIGS. 4*a*-4*c* show print target flattening according to an example.
Figure 4B:
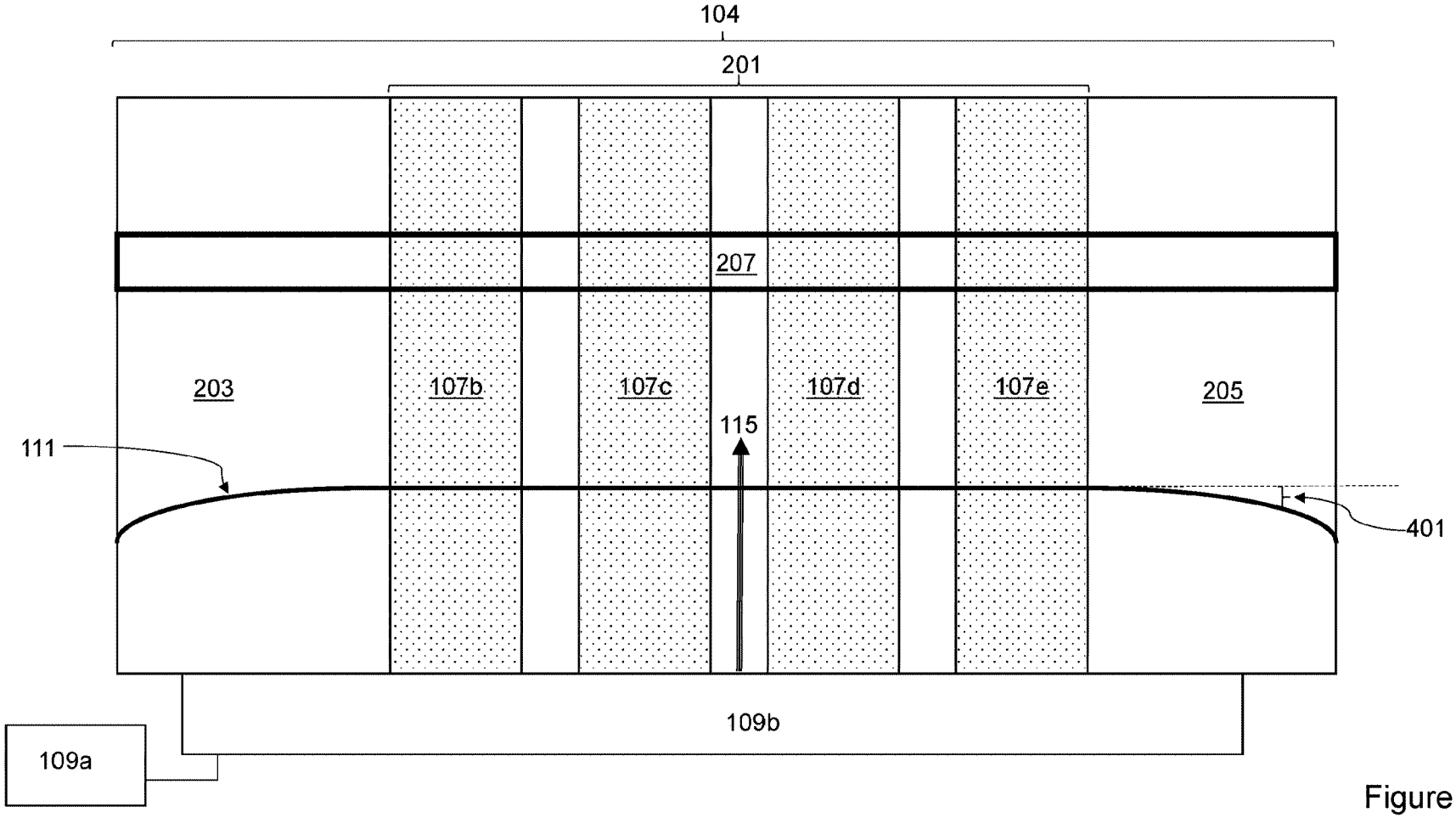
Figure 4C:
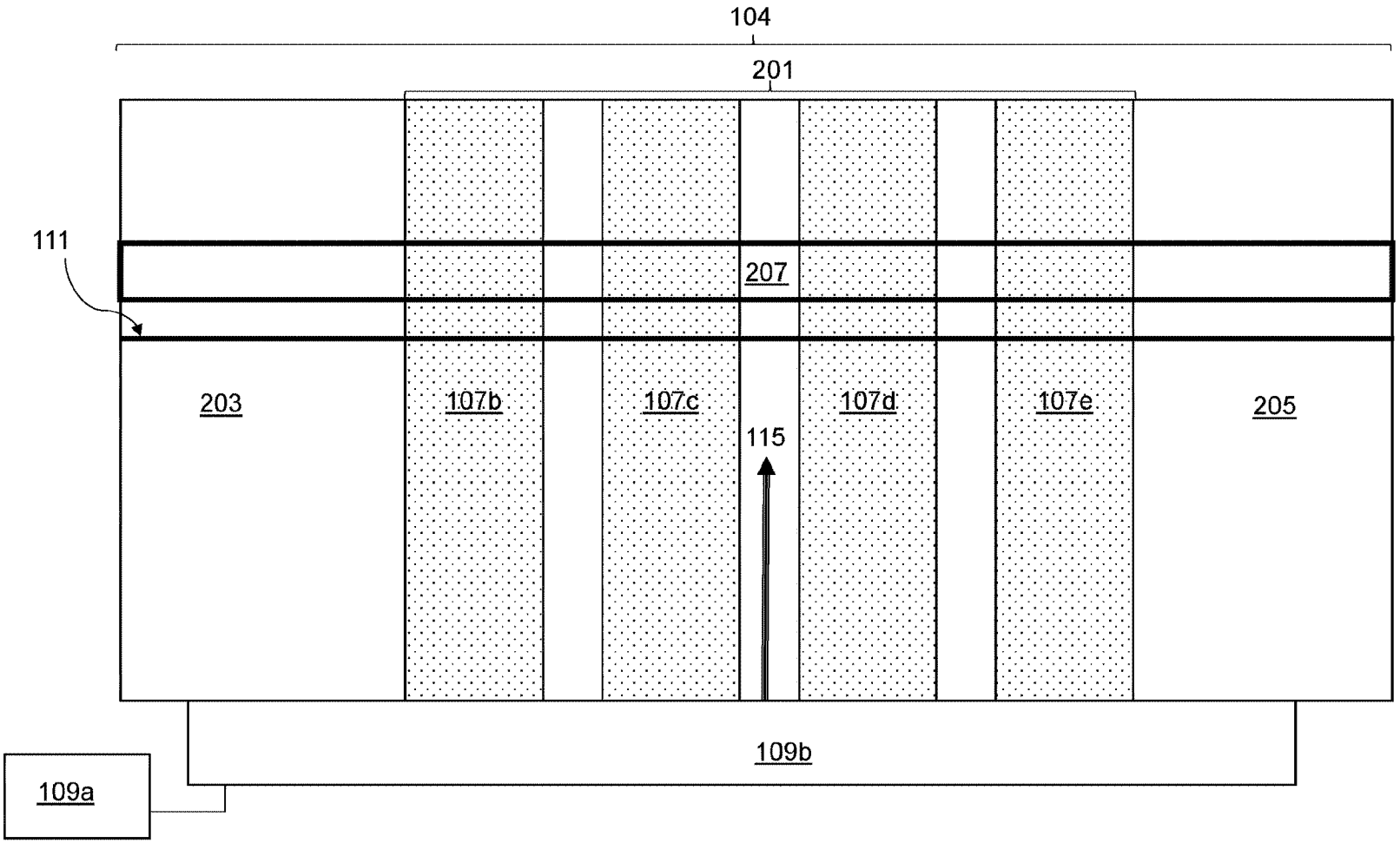

An example of the flattening operation is explained with reference to FIGS. 4*a*-4*c*. In this example, the print target 111 is curled up or wrinkled around the edges as it comes in contact with the print target support assembly 101. In examples, the print target 111 may be curled or wrinkled in the non-belt areas 203 and 205 due to the absence of belts and respective pinch rollers in the non-belt areas 203 and 205. An angle 401 may result between the leading edges of the print target 111 in the belt area 201 and the non-belt area 205.

In examples, the controller 109*a* controls the flattening arrangement 109*b* to progressively flatten the print target 111 starting from a central region of the surface 104 and progressing towards outer regions of the surface 104. The flattening arrangement 109*a* may, for example, comprise a vacuum assembly 109*b* as has been described.

The controller 109*a* controls the vacuum assembly 109*b* to continue applying vacuum to the regions of the surface 104 in which the print target 111 has been flattened, and thereafter, additionally, controls the vacuum assembly to apply vacuum to regions of the surface 104 adjacent therewith. This being the case, the controller 109*a* controls the vacuum assembly 109*b* to progress from the central region to outer regions of the surface 104 in stages. Therefore, the angle 401 is progressively reduced as the print target 111 advances towards the print zone 207 (as shown in FIG. 4*b*) and the angle 401 is reduced to zero by the time the print target 111 passes under the print zone 207 (as shown in FIG. 4*c*). The effect of the progressive vacuum being applied is that the angle 401 is progressively reduced to zero.

In examples, in response to flattening a leading edge of the print target 111 across the surface 104, the controller 109*a* controls the vacuum assembly 109*b* to apply vacuum across the print zone 207, thereby causing appropriate friction across the belt area 201 and the non-belt areas 203 and 205.

In summary, examples in this disclosure provide a print platen support assembly providing a surface comprising a belt area and a non-belt area, thereby, for example, reducing manufacturing cost associated with a print target support assembly. A flattening arrangement may ensure flatness of print target as the print target passes under a print zone by progressive flattening, wherein the flattening arrangement causes a portion of the print target located in a central region of the surface to be flattened first and thereafter progressing to flatten the print target located in outer regions of the surface. The friction caused in the belt and non-belt areas ensures good performance in terms of target skew, registration errors, jams and wrinkles.

The description herein has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. A print target support assembly comprising:

a print platen structure providing an upper surface to support a print target as the print target passes under a print zone, the print zone arranged across the surface perpendicular to a direction of print target advance, the surface comprising an inner belt area bounded on each side by an outer non-belt area;

a belt advance mechanism, to advance a belt running across the inner belt area of the surface in the direction of print target advance, to advance the print target under the print zone; and a flattening arrangement to flatten the print target onto the surface, under the print zone, across the inner belt area and the outer non-belt areas of the surface, wherein the flattening arrangement comprises a vacuum assembly to apply vacuum under the platen, in order to flatten a print target progressively onto the surface, wherein the vacuum assembly is to apply vacuum in a plurality of vacuum zones across the platen, progressively, starting from a zone corresponding with the inner belt area and progressing towards a zone corresponding with the outer non-belt area.

2. A print target support assembly according to claim 1, wherein the flattening arrangement comprises a vacuum assembly to apply vacuum under the platen, in order to flatten a print target onto the surface, wherein the vacuum assembly is to apply vacuum in a first vacuum zone, corresponding with the inner belt area, and in a second vacuum zone, corresponding with the outer non-belt areas.

3. A print target support assembly according to claim 2, wherein the vacuum assembly is to start applying vacuum in the first vacuum zone before applying vacuum in the second vacuum zone, to flatten the print target onto the surface, progressively, from the inner belt area of the surface towards the outer non-belt area of the surface.

4. A print target support assembly according to claim 1, wherein the flattening arrangement comprises a plurality of pinch rollers located in the inner belt area.

5. A print target support assembly according to claim 1, wherein the width of each of the outer non-belt areas is equal to or greater than a width of the belt.

6. A page wide array printer comprising a print target support assembly according to claim 1.

7. A print target support assembly comprising:

a print platen structure providing an upper surface to support a print target as the print target passes under a print zone, the surface comprising a belt area and a non-belt area;

a belt advance mechanism to advance a belt located across the belt area to advance the print target in contact with the belt under the print zone;

a flattening arrangement comprising a first flattening arrangement located in the belt area to apply vacuum corresponding with the belt area and a second flattening arrangement located in the non-belt area to apply vacuum corresponding with the non-belt area, wherein the first flattening arrangement is to start applying vacuum corresponding with the belt area before the second flattening arrangement is to apply vacuum corresponding with the non-belt area to flatten the print target onto the surface progressively from the belt area of the surface towards the non-belt area of the surface.

8. A print target support assembly according to claim 7, wherein the belt area is located along a mid-portion of the surface and is bounded on each side by a portion of the non-belt area.

9. A print target support assembly according claim 7, wherein the first flattening arrangement comprises a plurality of pinch rollers located in the belt area.

10. A print target support assembly according to claim 7, wherein the second flattening arrangement does not comprise a pinch roller located in the non-belt area.

11. A print target support assembly according to claim 7, wherein the width of the non-belt area is equal to or greater than a width of the belt.

12. A print target support assembly comprising:

a print platen structure providing an upper surface to support a print target as the print target passes under a print zone;

a belt mechanism to advance a belt running across the surface in a direction of print target advance to advance the print target under the print zone; and a flattening arrangement to flatten the print target onto the surface as the print target advances under the print zone, the flattening arrangement causes the print target to be progressively flattened starting from a central region of the surface and progressing towards outer regions of the surface, wherein the flattening arrangement comprises a vacuum assembly to apply a vacuum under the platen, to flatten a print target onto the surface, wherein the vacuum assembly is to apply vacuum corresponding the central region and vacuum corresponding with the outer regions.

13. A print target support assembly according to claim 12, wherein, in response to flattening a leading edge of the print target, the flattening arrangement causes vacuum to be applied across the print zone.

14. A print target support assembly according to claim 12, wherein the surface comprises an inner belt area, bounded on each side by an outer non-belt area, and wherein the belt is located across the belt area.

15. A non-transitory machine readable medium comprising instructions which, when executed by a processor, cause the processor to:

operate a flattening arrangement to produce a first vacuum under a central region of a surface provided by a print platen structure to flatten a portion of print target, and thereafter in addition, operate the flattening arrangement to produce a second vacuum to flatten the print target on either side of the central region, as the print target advances under the print zone.

* * * * *